US008063588B1

(12) United States Patent
Ribarich et al.

(10) Patent No.: US 8,063,588 B1
(45) Date of Patent: Nov. 22, 2011

(54) SINGLE-INPUT CONTROL CIRCUIT FOR PROGRAMMING ELECTRONIC BALLAST PARAMETERS

(75) Inventors: Thomas J. Ribarich, Laguna Beach, CA (US); Peter Bredemeier, Pr. Oldendorf (DE)

(73) Assignee: International Rectifier Corporation, El Segundo, CA (US)

( * ) Notice: Subject to any disclaimer, the term of this patent is extended or adjusted under 35 U.S.C. 154(b) by 694 days.

(21) Appl. No.: 12/192,110

(22) Filed: Aug. 14, 2008

(51) Int. Cl.
*H05B 37/02* (2006.01)

(52) U.S. Cl. ..... 315/360; 315/209 R; 315/362; 315/307; 315/291; 331/111; 331/129; 361/93.2; 361/91.6

(58) Field of Classification Search ..... 315/307, 315/291, 209 R, 360, 362, 224, DIG. 4, DIG. 5, 315/DIG. 7; 331/111, 113 R, 129, 143; 361/56, 361/57, 18, 79, 91.5, 93.2, 91.6; 363/56.02, 363/62, 98, 132
See application file for complete search history.

(56) References Cited

U.S. PATENT DOCUMENTS 6,031,342 A * 2/2000 Ribarich et al. ..... 315/291
6,211,623 B1 * 4/2001 Wilhelm et al. ..... 315/224
6,677,719 B2 * 1/2004 Ortmeyer, II ..... 315/291
6,879,115 B2 4/2005 Ribarich
7,019,468 B2 3/2006 Deurloo et al.
7,109,665 B2 * 9/2006 Green ..... 315/224
7,109,668 B2 9/2006 Pogodayev et al.
7,187,244 B2 * 3/2007 Ribarich et al. ..... 331/111
7,239,094 B2 7/2007 Radzinski et al.
2007/0096662 A1 5/2007 Ribarich et al.
2007/0108915 A1 5/2007 Ribarich
2008/0042595 A1 2/2008 Ribarich

OTHER PUBLICATIONS

Cecilia Contenti, IRPLMB1E-25W 230VAC Small Size Ballast Using IR2520D, International Rectifier, Application Note AN-1062, Mar. 2, 2004.

* cited by examiner

*Primary Examiner* — Haiss Philogene
(74) *Attorney, Agent, or Firm* — Fulwider Patton LLP

(57) ABSTRACT

A circuit uses a single control input to an oscillator of an electronic ballast to program the parameters of soft-start frequency, pre-heat frequency, ignition ramp time, and ballast run frequency. The output frequency of the oscillator is based on an electrical parameter at the control input node. A resistor-capacitor network may be used to program the soft-start ramp time and ignition ramp time. The resistive element of the restive-capacitance network may be used to program the pre-heat frequency. A switchable impedance may be used to program the ballast run frequency. A look-up table circuit may also be used in the alternative to implement a single control input for the oscillator of an electronic ballast.

19 Claims, 5 Drawing Sheets

SINGLE-INPUT CONTROL CIRCUIT FOR PROGRAMMING ELECTRONIC BALLAST PARAMETERS

FIELD OF THE INVENTION

The present invention relates generally to electronic ballasts used to operate fluorescent lamps. In particular, the invention pertains to circuits and methods used to control the output frequencies for preheating and ignition of a fluorescent lamp by an electronic ballast.

BACKGROUND

Electronic ballasts are used in many fluorescent lighting applications. Electronic ballast circuits typically employ transistors or other semiconductor components to convert mains voltage into high-frequency AC while also regulating the current flow in the lamp. The design and operation of these circuits include programming a plurality of parameters relating to the control of the fluorescent lamp, including lamp soft-start frequency, a pre-heat frequency, ignition frequency and ramp time, and final running frequency. These various frequencies are often generated by the ballast control circuit using a voltage controlled oscillator (VCO) which provides different frequencies for an output operating signal based on a voltage level or current provided at the input of the VCO. The power to the lamps is controlled by varying the output frequency of the VCO. Another timing circuit may be provided to program the time period during which the operating signal remains at each of the frequencies above, and yet another circuit is often provided to program the sweep time between each frequency.

Programming for rapid-starting often involves preheating a fluorescent lamp's electrodes using a higher pre-heat frequency before the required voltage for striking the arc is applied at the lower resonance frequency. The lamp will light after a predetermined preheat time as the frequency sweeps through the resonance frequency during the ignition ramp time. This can significantly increase the expected life of the lamp compared to instant-starting a lamp by applying the jolt of required voltage without a warm-up period, which may increase erosion of the electrode and result in fewer lamp starts before failure. Modern lamps require an accurate preheat time for a more controlled start. If the minimum frequency has been chosen below or very close to the resonant frequency, the circuit will work near resonance.

Electronic ballasts may employ two power MOSFETs driven to conduct alternately in a totem pole (half-bridge) topology in conjunction with L-C series resonant circuits, with the fluorescent lamp(s) across one of the reactances. Many electronic ballasts for fluorescent lighting applications sold on the market today also include a standard ballast control IC. There are a number of electronic ballast control ICs on the market, including the IR215X and IR2520D series which are monolithic power integrated circuits capable of driving low-side and high-side MOSFETs or IGBTs from logic level, ground referenced inputs, and which can provide self-oscillating or synchronized oscillation functions set via external resistive and/or capacitance components.

At startup, the output frequency of the VCO can be as much as about 2.5 times the minimum frequency of the circuit. This minimizes voltage spikes and lamp flash at startup. The frequency ramps down towards the resonant frequency of the high-Q ballast output stage, causing the lamp voltage and lamp current to increase. During this time, the filaments of the fluorescent lamp are pre-heated to the emission temperature to promote a long lamp life. The frequency keeps decreasing until the lamp ignites. If the lamp ignites successfully, the ballast control IC enters a run mode. If the minimum frequency has been chosen below or very close to the resonant frequency, the integrated circuit will work near resonance and will adjust the frequency to maintain zero-voltage switching at the half-bridge and to minimize the losses in the transistors. If the minimum frequency has been chosen higher than the resonant frequency the ballast control IC will work at the minimum frequency.

Control ICs can perform a variety of functions ranging from power factor correction to lamp/ballast control. The parameters of soft-start frequency, pre-heat frequency, ignition ramp time, and final run frequency may be programmed independent of each other using multi-input solutions.

SUMMARY OF THE INVENTION

One aspect of the invention is to program various electronic ballast parameters using a single control input. A single-input control circuit is used for programming different electronic ballast parameters, including the preheat frequency and run frequency, for an electronic ballast. Programming several parameters using a single control input would reduce the size of the IC footprint and allow more compact fluorescent lighting configurations and applications.

A circuit for programming electronic ballast parameters comprising an oscillator electrically coupled to a control input node will be described. The oscillator produces an output frequency in response to an electrical parameter at the control input node. Connected to the control input node is a resistance-capacitance network having a time constant, a first switchable impedance capable of being enabled and disabled, a second switchable impedance in parallel with the first switchable impedance also being capable of being enabled and disabled, and a zener diode.

In one aspect, the circuit further comprises a switch connecting the control input node to ground, wherein the oscillator is a voltage controlled oscillator, and the electrical parameter is a voltage. The resistance-capacitance network includes at least one resistor and at least one capacitor, and the first and second switchable impedances are a first and second current source, respectively, capable of being enabled and disabled. Opening the switch causes the voltage at the control input node to increase at a rate in accordance with the time constant of the resistance-capacitance network to a voltage set by the first current source when the first current source is enabled, and the output frequency of the voltage controlled oscillator decreases as the voltage at the control input node increases, such that the voltage controlled oscillator produces an output frequency that decreases from a soft-start frequency to a pre-heat frequency for a fluorescent lamp. After an amount of time during which the voltage controlled oscillator produces the pre-heat frequency as the output frequency, the second current source is enabled such that the voltage at the control input node increases further at a rate in accordance with the time constant of the resistance-capacitance network, and the voltage controlled oscillator produces an output frequency that decreases from the pre-heat frequency to a run frequency while sweeping through a resonance frequency, wherein the output frequency is decreased in accordance with the time constant of the resistance-capacitance network, and wherein the second current source and the zener diode set a run voltage at the control input node to cause the voltage controlled oscillator to produce the run frequency as the output frequency.

In another aspect, the resistance-capacitance network includes at least one resistor and at least one capacitor, and the first and second switchable impedances are a first and second current source, respectively, each capable of being enabled and disabled. The oscillator is a voltage controlled oscillator such that the output frequency of the voltage controlled oscillator increases as the electrical parameter of voltage at the control input node increases, and a pre-heat voltage at the control input node is set by the zener diode and the enabled first current source and the enabled second current source to cause the voltage controlled oscillator to produce a pre-heat frequency as the output frequency. After an amount of time during which the voltage controlled oscillator produces the pre-heat frequency as the output frequency, the second current source is disabled to cause the voltage at the control input node to decrease from the pre-heat voltage to a run voltage at a rate in accordance with a time constant of the resonance network. A switch connects the control input node to ground and the run voltage at the control input node is set by the at least one resistor and the first current source. The voltage controlled oscillator decreases the output frequency from a pre-heat frequency to a run frequency to sweep through a resonance frequency to ignite a fluorescent lamp.

In yet another aspect, a circuit for programming electronic ballast parameters uses a look-up table to control an electrical parameter at the control input node of an oscillator, and the oscillator produces an output frequency in response to the electrical parameter. The look-up table may receive an electrical signal such as a voltage across a resistor, or a resistive network, where the voltage may fall within a voltage window corresponding to a specific parameter set, which may include frequencies and times. The look-up table may alternatively receive an electrical signal output from a digital interface based a serial bit stream input.

The invention will now be described in connection with certain preferred embodiments directed to an apparatus of a single-input control circuit for programming electronic ballast parameters with reference to the following illustrative figures so that it may be more fully understood. Other features and advantages are inherent in the system and methods claimed and disclosed or will become apparent to those skilled in the art from the following detailed description and accompanying drawings.

DETAILED DESCRIPTION OF THE PREFERRED EMBODIMENTS

In the following description of the preferred embodiment, reference is made to the accompanying drawings which illustrate specific embodiments of the invention. Embodiments of the invention will be described with respect to electronic ballast applications and devices, and it is to be understood that the invention is not limited to the specific embodiments described and illustrated herein.

To properly control a fluorescent lamp, the electronic ballast is programmed with the different parameters for operating the lamp. These parameters include a soft-start frequency and ramp time, a preheat frequency, an ignition ramp time, and a final run frequency. Prior solutions for programming these parameters include multi-input solutions. Since these core parameters can vary significantly from one lamp type to another, several inputs are used to program each parameter independently.

Figure 1:
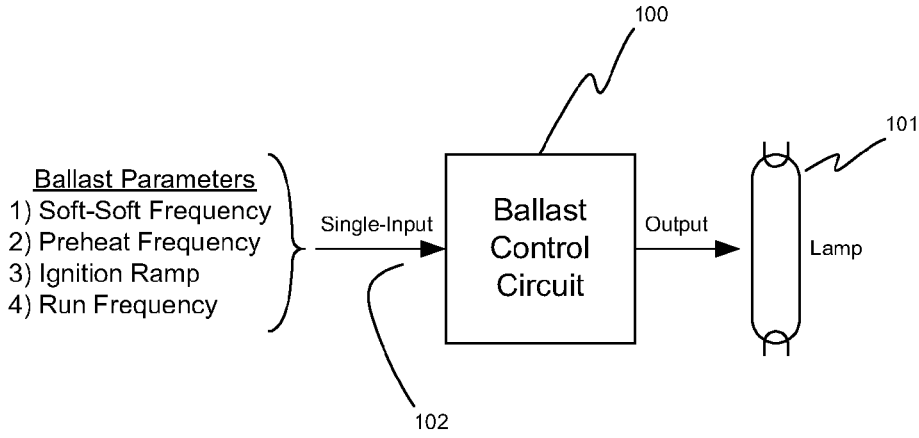
FIG. 1 illustrates a block diagram of an embodiment of the invention.

FIG. 1 illustrates a block diagram of a preferred embodiment of a control circuit that allows for each of these parameters to be programmed independently using a single control input to the ballast control circuit. Ballast control circuit 100 operates a typical fluorescent lamp 101. Soft-start frequencies may be used to minimize the stress on the lamp components during initial turn-on of ballast control circuit 100. The preheat frequency also sets the filament current for heating the lamp filaments to their correct emission temperature during the preheat period before the a frequency sweep during the ignition ramp time to generate a high voltage across the lamp for ignition. A final run frequency sets the running power in the lamp. The soft-start ramp time and frequency, the preheat frequency, the frequency sweep ignition ramp time and frequency, and the run frequency, can be programmed using a single input 102 to the control circuit 100. Such a circuit may be useful to reduce the size and number of pins for an electronic ballast integrated circuit. Other ballast control circuits are disclosed in U.S. Patent Publication Nos. 2007/0108915 and 2008/0042595, the contents of which are incorporated by reference in their entirety. U.S. Patent Publication No. 2007/0108915 discloses a ballast control integrated circuit having eight pins, and U.S. Patent Publication No. 2008/0042595 discloses a ballast control integrated circuit having six pins.

Figure 2:
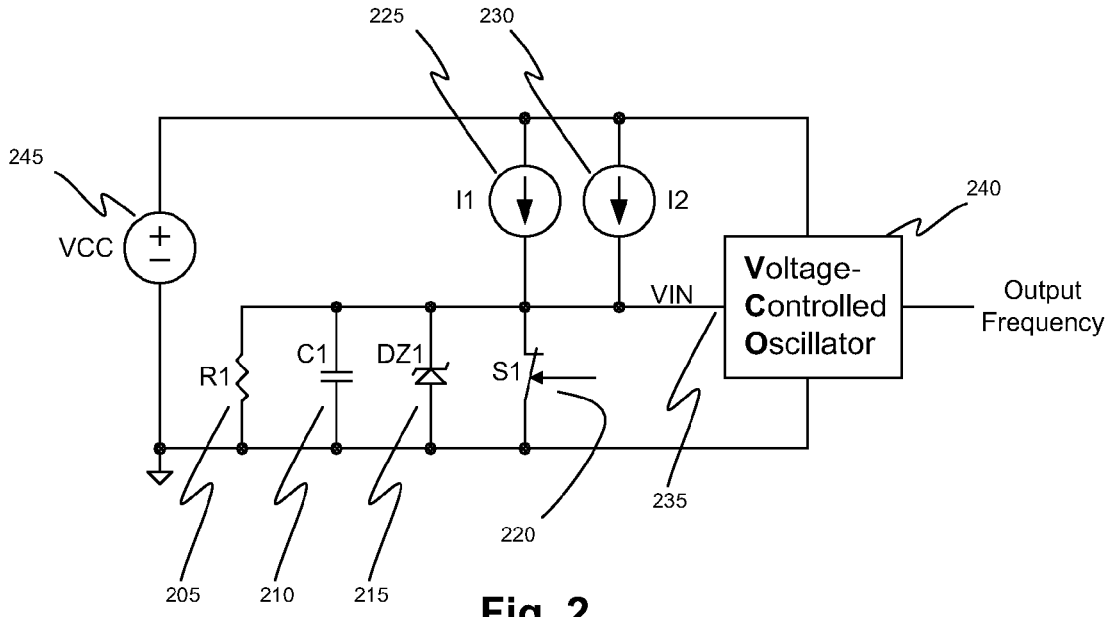
FIG. 2 shows a circuit diagram of a single input ballast control circuit in accordance with a first embodiment of the present invention.

As shown by FIG. 2, one embodiment of a single-input ballast control circuit 100 includes a resistor R1 205, a capacitor C1 210, a zener diode DZ1 215, a switch S1 220, and two current sources I1 225 and I2 230. Resistor R1 205, capacitor C1 210, zener diode DZ1 215, and switch S1 220, are all connected in parallel between the control input voltage node 235 and a common ground COM. Current sources I1 225 and I2 230 are connected to the control input voltage node 235 such that the currents are sourced into the control input voltage node 235. The current source may be a standard IC current source, or it may be a resistor in combination with a switch. Both are meant to be encompassed by the term switchable impedance. The control input voltage node 235 connects to the input of a voltage-controlled oscillator VCO 240. Voltage controlled oscillator 240 then outputs a frequency as a function of the voltage VIN at the control input node 235. It is to be understood that the oscillator may produce an output frequency based on an electrical parameter other than voltage, and the invention is not limited to a voltage controlled oscillator. The output frequency controls the operating frequency of the electronic ballast. The various ballast parameters are programmed for different frequency levels and how the frequency levels are changed versus time. The circuit is supplied by a standard DC supply voltage VCC 245. Fifteen volts dc is a typical supply voltage.

Figure 3:
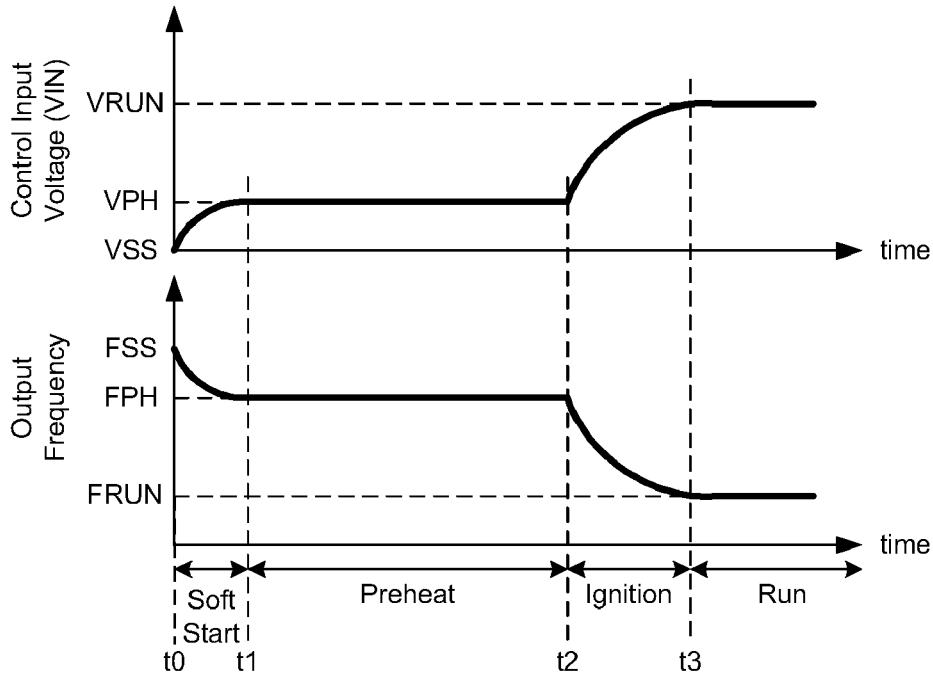
FIG. 3 illustrates a frequency timing diagram for the first embodiment of the present invention.

FIG. 3 illustrates a frequency timing diagram of the oscillator's frequency response to control input voltage for an inversely proportional voltage controlled oscillator. Initially, switch S1 220 is closed to connect control input node 235 to COM, while first current source I1 225 is enabled, and second current source I2 230 is disabled. At time=t0, switch S1 220 is opened and control input voltage VIN at control input node 235 ramps up smoothly at a rate given by the time constant of the resistor-capacitor network of capacitor C1 210 and resistor R1 205. This ramp time (from time=t0 to time=t1) is the soft-start time during which the ballast operating frequency (output frequency of oscillator VCO 240) will ramp down smoothly from a high starting frequency to a lower, second frequency as control input voltage VIN ramps up smoothly from VSS to a higher, second voltage level. This higher, second voltage level is the preheat voltage VPH, and is set by first current source I1 225 and the resistor R1 205. The preheat voltage VPH corresponds to a second ballast operating frequency, which is the preheat frequency FPH. Control input voltage VIN stays at this second voltage level VPH for the duration of the preheat time (from time=t1 to time=t2). The duration for the preheat time may be set by a separate digital counter or oscillator, or other input which sets a time constant by ramping a capacitor voltage, or any other method known in the art.

When the preheat time has ended, the second current source I2 230 is then enabled and the control input voltage VIN ramps up again at a rate given by the time-constant of capacitor C1 210 and resistor R1 205. A pulse counter or other circuit known in the art can be used to control the timing for enabling second current source I2 230 at time t2 at time t2 which is the end of the preheat time. The ramp time from time t2 to time t3 is the ignition ramp time during which the ballast operating frequency ramps down from the preheat frequency FPH to the final run frequency FRUN as the control input voltage ramps up smoothly from VPH to a higher, third voltage level, VRUN. As the frequency ramps down from the preheat frequency to the run frequency, the ballast resonant output stage sweeps through the resonance frequency for igniting the fluorescent lamp. The frequency continues ramping down to the final run frequency where lamp is driven at the desired power level. The higher, third control input voltage level VRUN is set by zener diode DZ1 215 (acting as a voltage regulator) and remains at this level from time=t3 onward until the circuit is turned off or reset. In this configuration, the input control voltage VIN changes over time in an ascending order from a lower start voltage VSS to the final run voltage VRUN. Since oscillator VCO 240 operates on an inverse proportion where the frequency decreases as the input voltage increases, the output frequency will therefore change over time in a descending order as the input control voltage VIN increases.

In this first embodiment, resistor R1 205 and capacitor C1 210 program the ballast soft-start and ignition ramp times; first current source I1 225 and resistor R1 205 program the ballast preheat frequency; and second current source I2 230 and zener diode DZ1 215 program the ballast run frequency.

Figure 4:
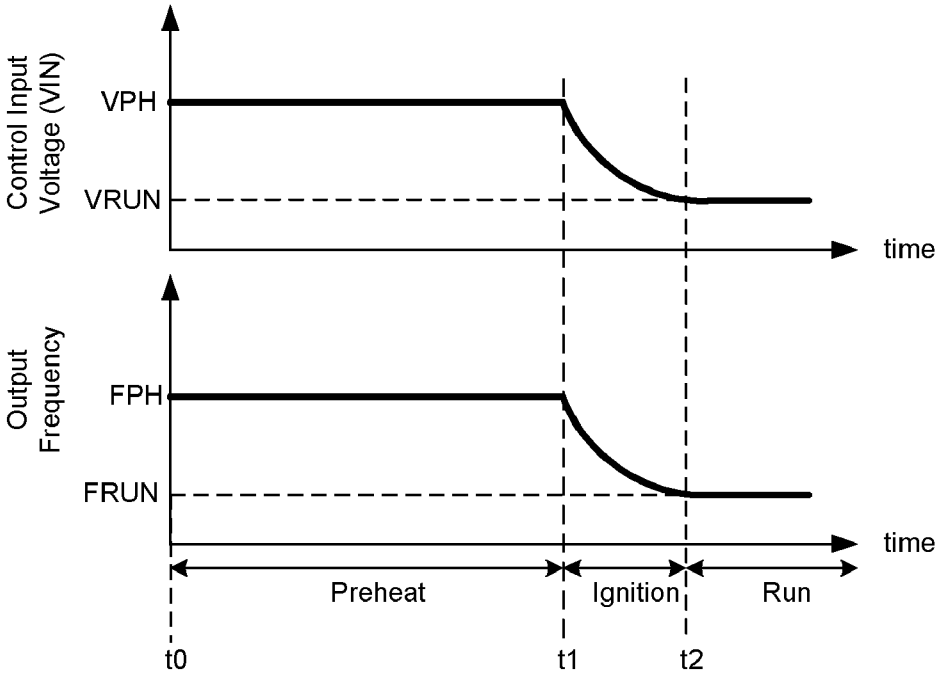
FIG. 4 illustrates a frequency timing diagram for an alternative implementation of the first embodiment of the present invention.

In a modification of the first embodiment, the output frequency of oscillator VCO 240 increases as the input voltage VIN increases. Current sources I1 225 and 12 230 are initially enabled on this modified embodiment. This will cause VIN to start at a higher voltage level set by the zener diode DZ1 215. Current source I2 230 is then disabled after the preheat time has ended and the control voltage VIN will ramp down to the final run level set by current source I1 225 and resistor R1 205. In this modified configuration, switch S1 205 is not needed, but the soft-start feature at initial start up no longer exists. FIG. 4 illustrates a frequency response for such a configuration using a voltage controlled oscillator having a proportional output frequency rather than an inversely proportional output frequency.

In this modification of the first embodiment, the zener diode DZ1 215 programs the preheat frequency; resistor R1 205 and capacitor C1 210 program the ignition ramp times; and current source I1 225 and resistor R1 205 program the ballast run frequency.

Figure 5:
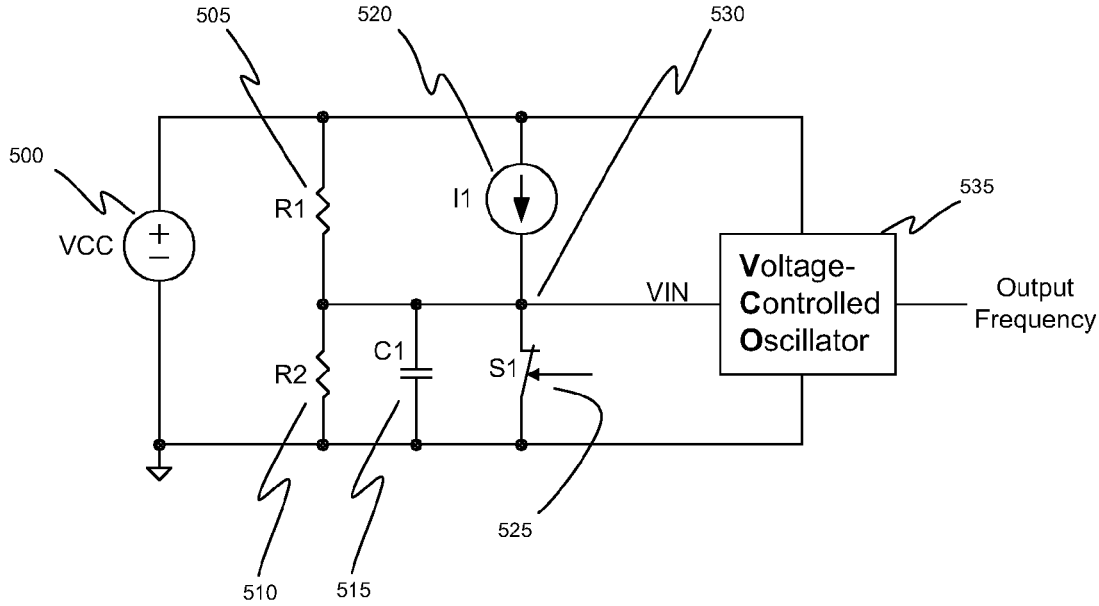
FIG. 5 shows a circuit diagram of a single input ballast control circuit in accordance with a second embodiment of the present invention.

As shown by FIG. 5, a second embodiment of the present invention includes an input supply voltage VCC 500, two resistors R1 505 and R2 510, a capacitor C1 515, a current source 11520, and a switch S1 525. The two resistors R1 505 and R2 510 are connected in series to form a standard voltage divider network between VCC 500 and COM. The node formed between the two resistors is the control input voltage node 530. Capacitor C1 515 is then placed from control input voltage node 530 to COM. Current source I1 520 is connected to control input voltage node 530 such that current is sourced into control input voltage node 530. Finally, switch S1 525 is connected from the control input voltage node 530 to COM. Control input voltage node 530 is then connected to the input of a voltage-controlled oscillator VCO 535 that generates an output frequency for controlling the operating frequency of the electronic ballast.

Figure 6:
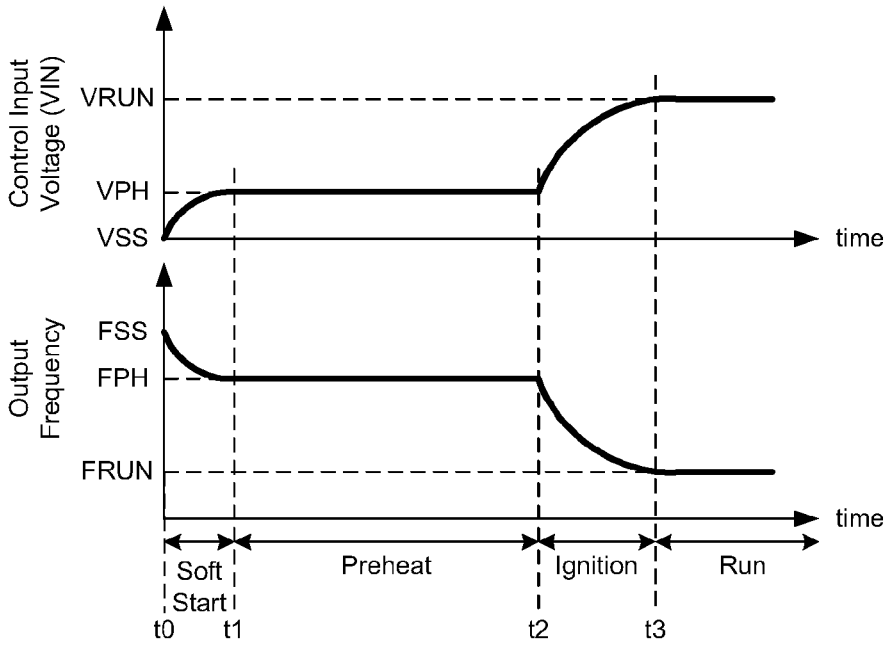
FIG. 6 illustrates a frequency timing diagram for the second embodiment of the present invention.

FIG. 6 illustrates a frequency timing diagram of the frequency response to the oscillator control input circuit voltage for the second embodiment of the present invention. Initially, switch S1 525 is closed to connect the control input voltage node 530 to COM, current source I1 520 is disabled (OFF), and the input supply voltage VCC 500 is fixed at a given voltage level. At time=t0, the switch S1 525 is opened and the control input voltage VIN ramps up at a rate according to the time constant of the resistive-capacitive network comprising capacitor C1 515 and resistors R1 505 and R2 510. This ramp time (from time=t0 to time=t1) is the soft-start time during which the ballast operating frequency will ramp down smoothly from a high soft-start frequency FSS to a lower, second frequency as the control input voltage ramps up smoothly from VSS to a higher, second voltage level VPH. This higher, second voltage level VPH is set by the supply voltage VCC 500 and the voltage divider formed by the two resistors R1 505 and R2 510. The corresponding second ballast operating frequency is the preheat frequency FPH. The control input voltage VIN stays at this level VPH for the duration of the preheat time (from time=t1 to time=t2).

When the preheat time has ended (at time=t2), current source I1 520 is then enabled and the control input voltage VIN ramps up again at a rate given by the time constant of capacitor C1515, and resistors R1 505 and R2 510. This ramp time (from time=t2 to time=t3) is the ignition ramp time during which the ballast operating frequency ramps down from the preheat frequency FPH to the final run frequency FRUN as the control input voltage ramps up smoothly from VPH to a higher, third voltage level, VRUN. As the frequency ramps down from the preheat frequency to the run frequency, the ballast resonant output stage sweeps through the resonance frequency to produce high voltages for igniting the lamp. The frequency continues ramping down to the final run frequency where the lamp is driven at the desired power level. The higher, third control input voltage level VRUN is set by the supply voltage VCC 500, the voltage divider resistors R1 and R2 and current source I1 520. The voltage level VRUN remains at this level from time=t3 until the circuit is turned off or reset. In this configuration, the input control voltage VIN changes over time in an ascending order from a lower start voltage to the final run voltage. Since voltage controlled oscillator VCO 535 has an inverse proportion where the frequency decreases as the input voltage increases, the output frequency will therefore change over time in a descending order as control input voltage VIN increases.

For a fixed supply voltage VCC in the second embodiment of the present invention, the resistors R1 505 and R2 510 and capacitor C1 515 program the ballast soft-start ramp time; the resistors R1 and R2 program the ballast preheat frequency; the resistors R1 505 and R2 510, capacitor C1 515 and current source I1 520 program the ballast ignition ramp time; and the resistors R1 505 and R2 510 and current source program the ballast run frequency.

Figure 7:
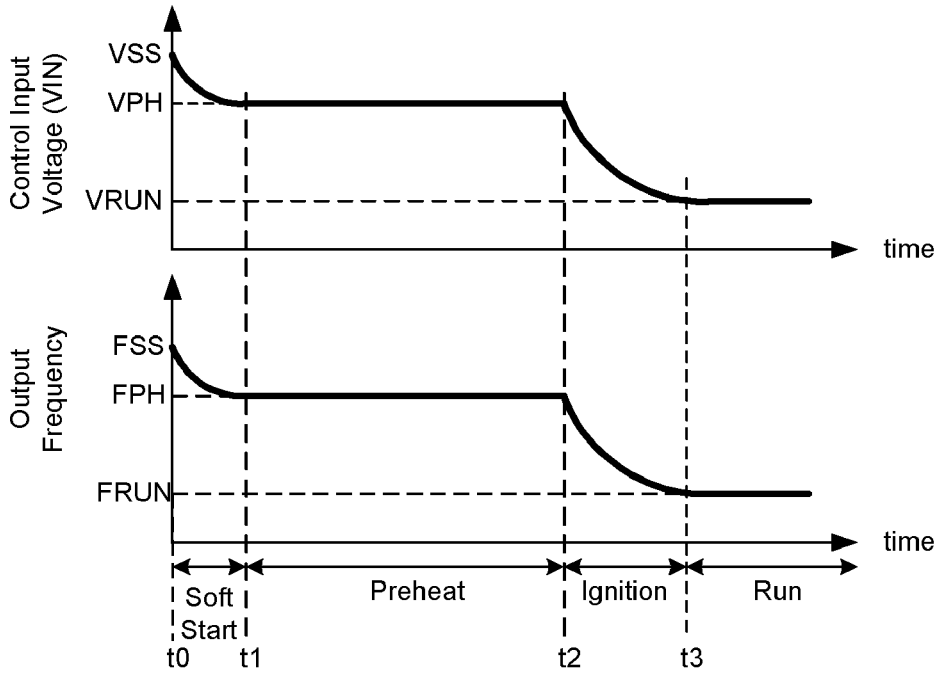
FIG. 7 illustrates a frequency timing diagram for an embodiment of the invention having a proportional output frequency.

If voltage controlled oscillator VCO 535 is modified such that the output frequency of oscillator VCO 535 increases as the input voltage increases, then the control input circuit is modified such that current source I1 520 is initially enabled. VIN can then be started at a higher soft-start voltage level and then ramp down quickly to a second, lower preheat voltage level set by VCC 500, I1 520, R1 505 and R2 510. Then I1 520 is disabled after the preheat time has ended and VIN ramps down to the final run level set by VCC 500, and R1 505 and R2 510. In this modified descending configuration, switch S1 525 is not needed. FIG. 7 illustrates a frequency response for such a configuration including a voltage controlled oscillator having a proportional output frequency rather than an inversely proportional output frequency.

In this modification of the second embodiment, VCC 500, 11520, and resistors R1 505 and R2 510 program the preheat frequency; capacitor C1 515 and resistor R1 505 programs the soft-start and ignition ramp times; and VCC 500 with resistors R1 505 and R2 510 program the ballast run frequency.

Figure 8:
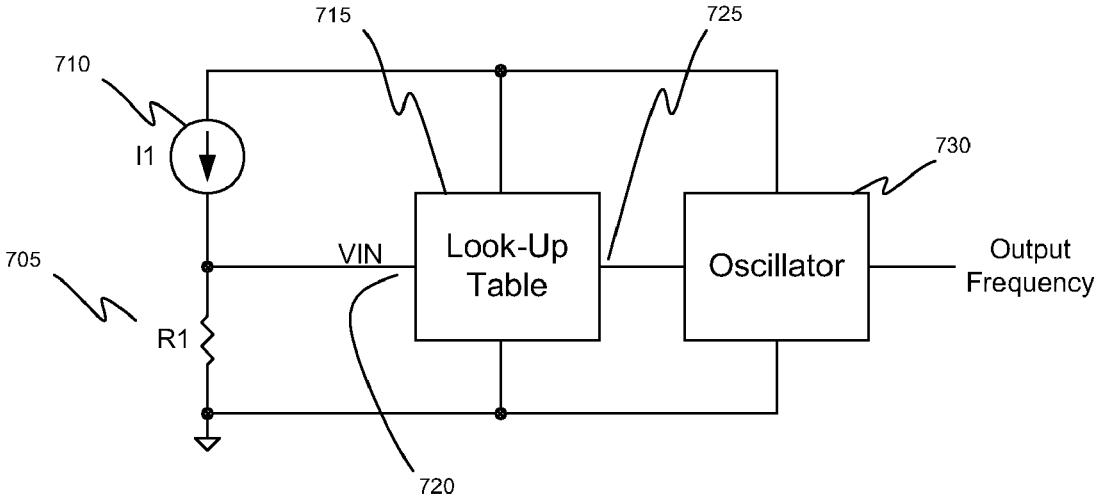
FIG. 8 shows a circuit diagram of a single input ballast control circuit having a look-up table in accordance with a third embodiment of the present invention.

As shown by FIG. 8, a third embodiment of the present invention includes a single programming resistor R1 705, a current source I1 710, and a look-up table circuit 715. Look-up table circuit 715 can be any circuit known in the art that is capable of providing look-up table functionality, including an IC. Current source I1 710 flows through the resistor 705 to produce a voltage VIN across the resistor. Immediately after the supply voltage to look-up table circuit 715 is powered on, current source I1 710 is maintained such that VIN is stabilized at a voltage level required for the particular lamp. The stabilized voltage level VIN is then read by look-up table circuit 715 to determine the ballast parameters, and the ballast parameters are locked in place, all before the ballast starts. It is preferable to take an accurate reading prior to powering on the complete look-up table circuit to avoid noise and other power fluctuations across resistor R1 705 and at input node 720. Input node 720 to look-up table circuit 715 preferably includes a number of pre-determined voltage windows depending on how many parameters are to be programmed and the programming resolution of each parameter. Each pre-determined voltage window corresponds to a different set of the ballast parameters stored within look-up table circuit 715. After the supply voltage reaches its fully powered state, the look-up table circuit locks the parameters, and outputs at output node 725 the parameters corresponding to the particular voltage window that encompassed voltage level VIN. Output node 725 of look-up table circuit 715 is connected to the input of oscillator 730 which generates output frequencies for starting and controlling the electronic ballast.

The look-up table circuit 715 outputs an electrical parameter, preferably a voltage, to control the output frequencies of oscillator 730. This voltage can remain fixed or vary over time in accordance with the values stored in look-up table circuit 715 which correspond to the input voltage VIN at input node 720. The soft-start frequency, the soft-start time, the preheat time, and the ignition ramp time, and run frequency, can all be programmed with resistor 705 and look-up table circuit 715. The voltage set by resistor R1 705 corresponds to a specific parameter set, including soft-start frequency, soft-start ramp time, preheat frequency, preheat time, ignition ramp time, and final run frequency, which are all stored in look-up table circuit 715. Alternatively, some of these parameters can be fixed to pre-determined levels to reduce the number of parameter combinations if the number of possible ballast parameter combinations exceeds the limit of possible voltage windows due to circuit limitations. In either case, a single input at input node 720 programs the ballast parameters.

To increase the number of possible programmable ballast parameters, a circuit similar to that shown in FIG. 5 can be used at input node 720, where two resistors (such as in a voltage divider network) and a current source (see, e.g., R1 505, R2 510 and 11520, in FIG. 5) are used to produce two separate voltage levels at a single node at different times. When current source I1 520 is turned on, the resulting voltage level produced by resistors R1 505 and R2 510 and current source I1 520 can then be read by look-up table circuit 715 to program one set of ballast parameters. Current source I1 520 can then be turned off and the resulting voltage can then be read by look-up table circuit 715 a second time to program a second set of ballast parameters.

Figure 9:
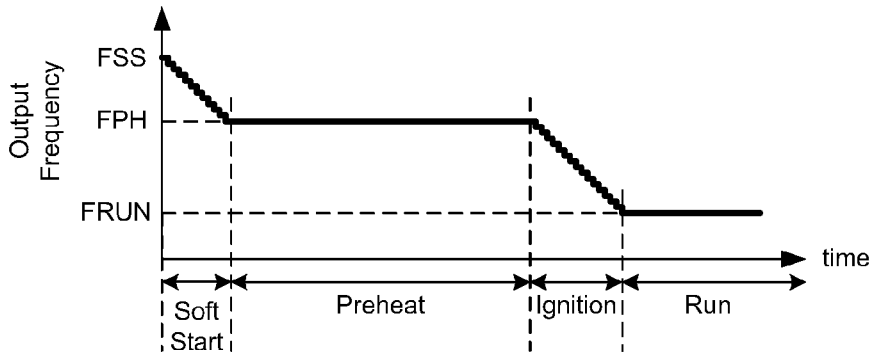
FIG. 9 illustrates a frequency timing diagram for the third embodiment of the present invention.

FIG. 9 illustrates a frequency timing diagram of the frequency response to the oscillator control input circuit voltage for the fourth embodiment of the present invention. When the ballast starts (at time=t0), the output frequency first starts at the higher soft-start frequency and then steps down in small increments to the preheat frequency. The frequency will remain at the preheat frequency for the duration of the preheat time (from time=t1 to time=t2). After the preheat time period has ended (at time=t2), the frequency then steps down again in small increments to produce a smooth ignition ramp during the ignition time (from time=t2 to time=t3) to the final run frequency. The frequency then remains at the run frequency from time=t3 until the circuit is turned off or reset.

Figure 10:
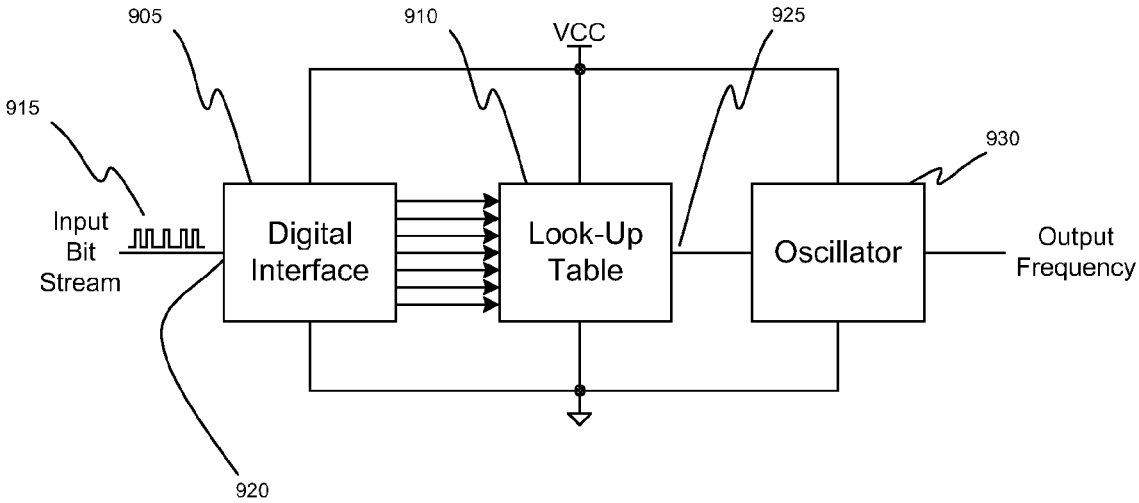
FIG. 10 shows a circuit diagram of the single input ballast control circuit having a digital interface and look-up table in accordance with a fourth embodiment of the present invention.

As shown by FIG. 10, a fourth embodiment of the present invention includes a digital interface 905 and a look-up table 910 for reading a serial bit stream of data for programming the ballast parameters. A bit stream 915 of a pre-determined number of bits is entered serially to a digital interface input 920. Bit stream 915 contains the information for programming the ballast parameters. The number of bits in bit stream 915 is determined by the number of ballast parameters to be programmed and the programming resolution of each parameter. Digital interface 905 reads bit stream 915 through a digital input 920 and sends the individual bits to look-up table 910 where the final ballast parameters are programmed. The output node 925 of look-up table 910 is connected to the input of a voltage controlled oscillator 930 which generates an output frequency for controlling the operating frequency of the electronic ballast. The resulting output frequency of the ballast versus time would correspond to that illustrated as in FIG. 9.

While several particular forms of the invention have been illustrated and described, it will also be apparent that various modifications may be made without departing from the scope of the invention. It is also contemplated that various combinations or subcombinations of the specific features and aspects of the disclosed embodiments may be combined with or substituted for one another in accordance with the invention. It is to be understood that the detailed description and the accompanying drawings as set forth hereinabove are not intended to be exhaustive or to limit the breadth of the present invention. Accordingly, it is not intended that the invention be limited, except as by the appended claims.

What is claimed is:

1. A circuit for programming electronic ballast parameters comprising:

an oscillator coupled to a control input node, the oscillator producing an output frequency in response to an electrical parameter at the control input node;

a resistance-capacitance network connected to the control input node, the resistance-capacitance network having a time constant, a first switchable impedance connected to the control input node, the first switchable impedance capable of being enabled and disabled;

a second switchable impedance connected to the control input node, and in parallel with the first switchable impedance, the second switchable impedance capable of being enabled and disabled; and a zener diode connected to the control input node.

2. The circuit of claim 1, further comprising a switch connecting the control input node to ground, wherein the oscillator is a voltage controlled oscillator, the electrical parameter being voltage, the resistance-capacitance network including at least one resistor and at least one capacitor, the first switchable impedance is a first current source capable of being enabled and disabled, and the second switchable impedance is a second current source capable of being enabled and disabled; and opening the switch causes the voltage at the control input node to increase at a rate in accordance with the time constant of the resistance-capacitance network to a voltage set by the first current source when the first current source is enabled, and the output frequency of the voltage controlled oscillator decreases as the voltage at the control input node increases, such that the voltage controlled oscillator produces an output frequency that decreases from a high soft-start frequency to a lower pre-heat frequency for a fluorescent lamp.

3. The circuit of claim 2, wherein after an amount of time during which the voltage controlled oscillator produces the pre-heat frequency as the output frequency, the second current source is enabled such that the voltage at the control input node increases further at a rate in accordance with the time constant of the resistance-capacitance network, and the voltage controlled oscillator produces an output frequency that decreases from the pre-heat frequency to a run frequency while sweeping through a resonance frequency;

the output frequency is decreased in accordance with the time constant of the resistance-capacitance network; and the second current source and the zener diode set a run voltage at the control input node to cause the voltage controlled oscillator to produce the run frequency as the output frequency.

4. The circuit of claim 1, wherein the resistance-capacitance network including at least one resistor and at least one capacitor, the first switchable impedance is a first current source capable of being enabled and disabled, the second switchable impedance is a second current source capable of being enabled and disabled, and the oscillator is a voltage controlled oscillator such that the output frequency of the voltage controlled oscillator increases as the electrical parameter of voltage at the control input node increases; and a pre-heat voltage at the control input node is set by the zener diode and the enabled first current source and the enabled second current source to cause the voltage controlled oscillator to produce a pre-heat frequency as the output frequency.

5. The circuit of claim 4, wherein after an amount of time during which the voltage controlled oscillator produces the pre-heat frequency as the output frequency, the second current source is disabled to cause the voltage at the control input node to decrease from the pre-heat voltage to a run voltage at a rate in accordance with a time constant of the resonance network;

the voltage controlled oscillator decreases the output frequency from a pre-heat frequency to a run frequency to sweep through a resonance frequency to ignite a fluorescent lamp; and wherein the run voltage at the control input node is set by the at least one resistor and the first current source.

6. A circuit for programming electronic ballast parameters comprising:

an oscillator connected to a control input node, the oscillator producing an output frequency based on an electrical parameter at the control input node;

a source of electrical energy;

a resistance-capacitance network connected between the source of electrical energy and the control input node, wherein the resistance-capacitance network having a time constant; and a switchable impedance connected to the control input node, the switchable impedance capable of being enabled and disabled.

7. The circuit of claim 6, further comprising:

a switch connecting the control input node to ground, wherein opening the switch causes the voltage at the control input node to increase at a rate in accordance with the time constant of the resistance-capacitance network, the resistance-capacitance network including at least one resistor and at least one capacitor; and the oscillator is a voltage controlled oscillator responsive to the voltage at the control input node, the voltage controlled oscillator decreasing the output frequency as the voltage at the control input node increases, such that the voltage controlled oscillator produces an output frequency that decreases from a soft-start frequency to a pre-heat frequency for a fluorescent lamp.

8. The circuit of claim 7, wherein after an amount of time during which the voltage controlled oscillator produces the pre-heat frequency as the output frequency, the switchable impedance is enabled such that the voltage at the control input node increases further at a rate in accordance with the time constant of the resistance-capacitance network;

the switchable impedance being a current source;

the voltage controlled oscillator produces an output frequency decreasing from the pre-heat frequency to a run frequency while sweeping through a resonance frequency, wherein the resistance-capacitance network controls the rate at which the output frequency is decreased in accordance with the time constant of the resistance-capacitance network;

the resistance-capacitance network includes a voltage divider network;

the source of electrical energy and the at least one resistor set a run voltage at the control input node to cause the voltage controlled oscillator to produce the run frequency as the output frequency; and the source of electrical energy is a voltage source.

9. The circuit of claim 6, wherein the oscillator is a voltage controlled oscillator responsive to the voltage at the control input node, the output frequency of the voltage controlled oscillator increasing as the voltage at the control input node increases, and wherein a pre-heat voltage at the control input node is set by the voltage source, the enabled current source, and at least one resistor from the resistance-capacitance network to cause the voltage controlled oscillator to produce a pre-heat frequency as the output frequency.

10. The circuit of claim 9, wherein after an amount of time during which the voltage controlled oscillator produces the pre-heat frequency as the output frequency, the current source is disabled to cause the voltage at the control input node to decrease from the pre-heat voltage to a run voltage at a rate in accordance with a time constant of the resistance-capacitance network;

the resistance-capacitance network includes a voltage divider network;

the voltage controlled oscillator decreases the output frequency from a pre-heat frequency to a run frequency to sweep through a resonance frequency to ignite a fluorescent lamp; and the run voltage at the control input node is set by the at least one resistor and the source of electrical energy.

11. A circuit for programming electronic ballast parameters comprising:

an oscillator connected to a control input node, the oscillator producing an output frequency based on an electrical parameter at the control input node;

a pre-heat frequency setting means for producing an electrical parameter at the control input node for causing the oscillator to output a selected pre-heat frequency;

a run frequency setting means for producing an electrical parameter at the control input node for causing the oscillator to output a selected run frequency;

an ignition ramp time setting means connected to the control input node, wherein the pre-heat frequency changes to the run frequency at a rate set by the ignition ramp time setting means;

a switch connecting the control input node to ground;

a resistance-capacitance network having a time constant, wherein opening the switch causes the voltage at the control input node to increase at a rate in accordance with the time constant of the resistance-capacitance network; and the oscillator produces an output frequency that decreases as the voltage at the control input node increases.

12. The circuit of claim 11, wherein the pre-heat frequency setting means includes a first current source and the resistance component of the resistance-capacitance network;

the run frequency setting means includes a second current source and a zener diode; and the ignition ramp time setting means includes the resistance-capacitance network of the soft-start ramp time setting means.

13. The circuit of claim 11, wherein the resistance-capacitance network includes a voltage divider network, and the pre-heat frequency setting means includes the voltage divider network and a voltage source;

the run frequency setting means includes the voltage divider network, the voltage source, and a current source; and the ignition ramp time setting means includes the resistance-capacitance network of the soft-start ramp time setting means.

14. A circuit for programming electronic ballast parameters comprising:

an oscillator connected to a control input node, the oscillator producing an output frequency based on an electrical parameter at the control input node;

a look-up table circuit connected to the control input node for the oscillator, the look-up table circuit having an input capable of receiving an electrical signal, wherein the look-up table circuit sets the electrical parameter at the control input node based on the electrical signal received through the input of the look-up table circuit;

means for generating the electrical signal to cause the oscillator to produce a desired output frequency.

15. The circuit of claim 14 wherein the means for generating the electrical signal further includes a digital interface capable of receiving a serial bit stream having a number of bits determined by the number of ballast parameters to be programmed.

16. The circuit of claim 15 wherein the digital interface reads the bit stream and sends the individual bits to the look-up table circuit;

the look-up table circuit having:

stored sets of electrical parameters for producing specific output frequencies from the oscillator, including a pre-heat frequency, a run frequency, an ignition ramp time, the rate the pre-heat frequency changes to the run frequency, a pre-heat time, and a soft-start ramp time, and a stored set of pre-determined bits, wherein each pre-determined bit stored in the look-up table circuit corresponds to a stored set of electrical parameters for producing a specific output frequency from the oscillator, and a selected set of electrical parameters at the control input node is set based on the individual bits received by the look-up table circuit.

17. The circuit of claim 14, wherein the means for generating the electrical signal further includes:

resistor connected between the source of electrical energy and an input of the look-up table circuit for setting the electrical signal at the input of the look-up table circuit; and a switchable impedance connected to the input of the look-up table circuit, the switchable impedance capable of being enabled and disabled.

18. The circuit of claim 17 wherein the look-up table circuit reads a voltage across the resistor, the look-up table circuit having:

stored sets of electrical parameters for producing specific output frequencies from the oscillator, including a pre-heat frequency, a run frequency, an ignition ramp time, the rate the pre-heat frequency changes to the run frequency, a pre-heat time, and a soft-start ramp time, and a stored set of pre-determined voltage windows;

wherein each pre-determined voltage window stored in the look-up table circuit corresponds to a stored set of electrical parameters for producing a specific output frequency from the oscillator, and a selected set of electrical parameters at the control input node is set based on whether the voltage is within one of the pre-determined voltage windows.

19. The circuit of claim 18 wherein at least one electrical parameter in each stored set of electrical parameters is fixed at a pre-determined value.

* * * * *